US012345246B2

(12) United States Patent
Morita

(10) Patent No.: US 12,345,246 B2
(45) Date of Patent: Jul. 1, 2025

(54) VARIABLE-DISPLACEMENT SWASH PLATE TYPE COMPRESSOR

(71) Applicant: Valeo Japan Co., Ltd., Saitama (JP)

(72) Inventor: Yujiro Morita, Saitama (JP)

(73) Assignee: Valeo Japan Co., Ltd., Saitama (JP)

( * ) Notice: Subject to any disclaimer, the term of this patent is extended or adjusted under 35 U.S.C. 154(b) by 0 days.

(21) Appl. No.: 18/024,341

(22) PCT Filed: Aug. 27, 2021

(86) PCT No.: PCT/JP2021/031477
§ 371 (c)(1),
(2) Date: Mar. 2, 2023

(87) PCT Pub. No.: WO2022/050183
PCT Pub. Date: Mar. 10, 2022

(65) Prior Publication Data

US 2024/0011480 A1 Jan. 11, 2024

(30) Foreign Application Priority Data

Sep. 2, 2020 (JP) ..... 2020-147452

(51) Int. Cl.
*F04B 1/122* (2020.01)
*F04B 1/14* (2020.01)
(Continued)

(52) U.S. Cl.
CPC ..... *F04B 1/122* (2013.01); *F04B 1/14* (2013.01); *F04B 1/141* (2013.01); *F04B 1/145* (2013.01);
(Continued)

(58) Field of Classification Search
CPC .. F04B 1/141; F04B 1/145; F04B 1/14; F04B 1/122; F04B 27/109; F04B 27/1036; F04B 27/10; F04B 27/1081
See application file for complete search history.

(56) References Cited

U.S. PATENT DOCUMENTS 6,386,846 B1 * 5/2002 Murase ..... F04B 39/0055 181/403
6,434,956 B1 8/2002 Ota et al.
(Continued)

FOREIGN PATENT DOCUMENTS

EP 1039129 A2 9/2000
EP 2093423 A1 8/2009
(Continued)

OTHER PUBLICATIONS

International Preliminary Report on Patentability issued in counterpart International Application No. PCT/JP2021/031477, dated Mar. 7, 2023 (10 pages).
(Continued)

*Primary Examiner* — Christopher S Bobish
(74) *Attorney, Agent, or Firm* — Osha Bergman Watanabe & Burton LLP

(57) ABSTRACT

A first bleeding passage 50 configured to allow a crank chamber 2 and a suction chamber 31 to constantly communicate with each other, and a second bleeding passage 60 configured to allow the crank chamber 2 and the suction chamber 31 to constantly communicate with each other are provided. The first bleeding passage 50 is made to communicate with the crank chamber 2 at least via a space (central hole space 54) defined by an insertion end portion of a shaft 7 in a central hole 12 that is formed in the center of a cylinder block 1 and into which the shaft 7 is inserted. The
(Continued)

second bleeding passage 60 is opened in an end surface 1*a* of the cylinder block 1 that is opposed to a swash plate 19.

8 Claims, 6 Drawing Sheets

(51) Int. Cl.
*F04B 1/141* (2020.01)
*F04B 1/145* (2020.01)
*F04B 27/10* (2006.01)

(52) U.S. Cl.
CPC ..... *F04B 27/10* (2013.01); *F04B 27/1036* (2013.01); *F04B 27/1081* (2013.01); *F04B 27/109* (2013.01)

(56) References Cited

U.S. PATENT DOCUMENTS 6,520,748 B2 * 2/2003 Yokomachi ..... F04B 27/109 417/269
6,579,071 B1 * 6/2003 Tarutani ..... F04B 27/1036 181/403
7,530,797 B2 * 5/2009 Ito ..... F04B 27/109 417/222.1
8,360,742 B2 * 1/2013 Kimoto ..... F04B 27/109 92/156
9,518,568 B2 * 12/2016 Ota ..... F04B 1/295
9,556,861 B2 * 1/2017 Suzuki ..... F04B 27/109
9,631,612 B2 * 4/2017 Ota ..... F04B 49/22
10,309,382 B2 * 6/2019 Teraya ..... F04B 39/0207
2003/0086791 A1 * 5/2003 Breindel ..... F04B 27/109 417/222.2
2006/0008359 A1 * 1/2006 Ito ..... F04B 27/1804 417/222.2
2007/0177988 A1 * 8/2007 Inoue ..... F04B 27/109 417/313
2009/0220356 A1 * 9/2009 Yamamoto ..... F04B 27/1804 417/222.1
2017/0122300 A1 * 5/2017 Teraya ..... F04B 27/109

FOREIGN PATENT DOCUMENTS

JP 2001-107854 A 4/2001
JP 2003-343440 A 12/2003
JP 2009-203888 A 9/2009
JP 2018-013851 A 1/2018
WO 2010-137811 A2 12/2010
WO 2015-199207 A1 12/2015
WO 2017-002784 A1 1/2017

OTHER PUBLICATIONS

Extended European Search Report issued in counterpart European Application No. 21864241.1, dated Apr. 16, 2024 (9 pages).

* cited by examiner

VARIABLE-DISPLACEMENT SWASH PLATE TYPE COMPRESSOR

TECHNICAL FIELD

The present invention relates to a variable-displacement swash plate type compressor having a configuration to appropriately adjust oil in a crank chamber defined by a cylinder block and a housing assembled with the cylinder block.

BACKGROUND ART

A compressor of this kind includes: a cylinder block in which plural cylinder bores are formed; a front housing assembled with a front side of this cylinder block and defining a crank chamber; and a rear housing that is attached to a rear side of the cylinder block via a valve plate and in which a suction chamber and a discharge chamber are formed. A piston is disposed in each of the cylinder bores of the cylinder block so as to be movable in a reciprocative manner. A shaft is supported in a rotatable manner by the front housing and the cylinder block. This shaft is provided with a swash plate configured to rotate integrally with the shaft and at a variable inclination angle with respect to the shaft. Engagement portions of the pistons are engaged with peripheral edge portions of the swash plate via shoes so as to convert rotary motion of the swash plate into reciprocating motion of the pistons via the shoes.

The compressor of this kind is provided with an intake passage configured to allow the discharge chamber and the crank chamber to communicate with each other, and a bleeding passage configured to allow the crank chamber and the suction chamber to communicate with each other. A control valve is further disposed in the intake passage so that this control valve regulates an amount of working fluid that flows from the discharge chamber into the crank chamber so as to control a pressure in the crank chamber. Thus, the inclination angle of the swash plate with respect to the shaft is varied to control a discharge amount. Because oil is mixed in the working fluid that flows in via the intake passage, this working fluid is supplied to the crank chamber so as to supply the oil to the crank chamber.

At this time, as a fluid that enters the crank chamber, there are an intake gas supplied from the discharge chamber, and a blowby gas that enters via clearances between the cylinder bores and the pistons. As a fluid that exits the crank chamber, there is a bleeding gas discharged via the bleeding passage to the suction chamber formed in the rear housing. Therefore, flows of these fluids change an amount of the oil (an amount of lubricant) in the crank chamber in accordance with an operation condition.

Incidentally, when the oil amount in the crank chamber is small, there is a possibility that lubrication of a sliding part such as the swash plate may become insufficient, thereby degrading reliability. In view of this, in related art, in order to prevent the oil from being taken out of the crank chamber (to maintain the oil within the crank chamber), devices have been studied, for example, to provide an inside of the crank chamber with a function of separating the oil.

For example, in a piston compressor disclosed in patent literature 1 below, a bleeding hole is formed in a shaft and constitutes part of a bleeding passage configured to release, to a suction chamber, working fluid that has flowed into the crank chamber. This bleeding hole formed in the shaft is configured with an axial direction passage disposed along an axis from a rear end toward a front end side of the shaft, and a radial direction passage communicating with this axial direction passage and opened to the crank chamber so as to constitute an inlet portion of the bleeding passage. Due to a centrifugal force generated by rotation of the shaft, the oil is separated from the working fluid taken in by suction via the radial direction passage.

CITATION LIST

Patent Literature

Patent Literature 1: JP2003-343440A
Patent Literature 2: WO2015/199207

SUMMARY OF INVENTION

Technical Problem

However, in the variable-displacement swash plate type compressor having the configuration in which the part of the bleeding passage configured to guide the working fluid from the crank chamber to the suction chamber is formed in the shaft so as to separate the oil by utilizing the centrifugal force generated by rotation of the shaft, the oil separation function is enhanced as the rotational speed increases, and accordingly, the oil is more likely to accumulate in the crank chamber. When the oil excessively accumulates in the crank chamber, the swash plate stirs the oil of high viscosity, which causes an inconvenience that heat generated by shear friction between the swash plate and the oil increases a temperature in the crank chamber.

In order to address such an inconvenience, the applicant of this invention proposed a configuration in which, in addition to a bleeding passage configured to allow a crank chamber and a suction chamber to communicate with each other via a hole formed in a shaft, a bypass passage configured to allow the crank chamber and the suction chamber to constantly communicate with each other is provided. A portion of this bypass passage that communicates with the crank chamber is located on a radially outer side of a locus of rotation of the swash plate, for example, below the crank chamber, and at a position of a bolt hole where a bolt configured to fasten the housings is inserted (see patent literature 2).

With such a configuration of patent literature 2, because the bypass passage is opened below the crank chamber and at the position of the bolt hole where the bolt is inserted, the oil can be stably discharged to the suction chamber from a portion inside the crank chamber that has a highest oil concentration.

However, because the oil is taken out by suction from a region where the oil is not misted, the oil is excessively discharged. Consequently, for example, at the time of high-load operation in which a pressure control valve disposed in the intake passage is closed so that oil supply from the discharge chamber cannot be expected, and at the time of low-flowrate (low-load) operation in which the oil that has been discharged to a refrigeration circuit does not return to the compressor, there is a possibility that the oil in the crank chamber may be exhausted to cause insufficient lubrication of the sliding part.

The invention has been achieved in consideration of such circumstances, and a main object is to provide a variable-displacement swash plate type compressor that makes it possible to accumulate an appropriate amount of lubricant in a crank chamber in accordance with an operation state change of a refrigeration circuit and to prevent excessive discharge of the lubricant to the refrigeration circuit so as to constantly secure lubricant supply to a sliding part.

Solution to Problem

In order to achieve the above object, a variable-displacement swash plate type compressor according to the invention includes: a cylinder block in which plural cylinder bores are formed; a front housing assembled with a front side of the cylinder block and defining a crank chamber; a rear housing that is attached to a rear side of the cylinder block and in which a suction chamber and a discharge chamber are formed; a shaft supported in a rotatable manner by the front housing and a central hole formed in a center of the cylinder block; a swash plate configured to rotate integrally with the shaft and attached at a variable inclination angle with respect to the shaft; pistons that are disposed in the plural cylinder bores disposed around the central hole of the cylinder block and that are configured to reciprocate by rotation of the swash plate; an intake passage configured to allow the discharge chamber and the crank chamber to communicate with each other; a pressure control valve disposed in the intake passage and configured to adjust an opening degree of the intake passage; a first bleeding passage configured to allow the crank chamber and the suction chamber to constantly communicate with each other; and a second bleeding passage configured to allow the crank chamber and the suction chamber to constantly communicate with each other, in which the first bleeding passage is configured to communicate with the crank chamber at least via a space defined by an insertion end portion of the shaft in the central hole, and the second bleeding passage is opened in an end surface of the cylinder block that is opposed to the swash plate.

Here, the space defined by the insertion end portion of the shaft in the central hole of the cylinder block (hereinafter referred to also as central hole space) refers to, for example, a space formed between a rear end portion of the shaft and the valve plate in the central hole in the case that the central hole is bored through the center of the cylinder block, and that the rear housing is assembled with the cylinder block via the valve plate.

The first bleeding passage communicating with the crank chamber via this central hole space is formed by making the central hole space communicate with the crank chamber via a gap between the central hole and the shaft and/or by making the central hole space communicate with the crank chamber via a hole, described later, formed in the shaft.

Moreover, the end surface of the cylinder block that is opposed to the swash plate refers to a front-side end surface of the cylinder block that defines the crank chamber, and refers to a portion of the end surface except the cylinder bores and the central hole. Furthermore, in the case that the cylinder block includes a recess on the crank chamber side in which the central hole is opened, and in the case that a bolt hole in which a bolt configured to fasten the housings is inserted is formed, the end surface of the cylinder block that is opposed to the swash plate refers to a portion of the end surface except the recess and the bolt hole.

In the above configuration, oil within the crank chamber is stirred by the swash plate swinging and rotating, and the oil is mixed with refrigerant within the crank chamber and misted. This misted working fluid including the refrigerant and the oil is rotated in the crank chamber by rotation of the swash plate, so that the misted working fluid undergoes a centrifugal separation effect. As a result, the working fluid in a region on a radially outer side of the crank chamber has a high concentration of the oil component whereas the working fluid in a region on a radially inner side of the crank chamber has a low concentration of the oil component.

Because the first bleeding passage communicates with the crank chamber via the space (central hole space) defined by the insertion end portion of the shaft in the central hole of the cylinder block, the working fluid having a low oil concentration, that is, refrigerant gas, in the crank chamber can be stably discharged. Meanwhile, because the second bleeding passage is opened in the end surface of the cylinder block that is opposed to the swash plate and on a radially outer side of the central hole, the working fluid having a relatively high concentration of the oil component can be discharged. Thus, the misted oil generated by stirring of the oil can be discharged to prevent an oil temperature from being increased by stirring of the oil. Meanwhile, the oil on a radially outer side of a locus of rotation of the swash plate (for example, oil that has flowed into an inside of the bolt hole in which the bolt configured to fasten the housings is inserted) is hardly stirred and not misted, and consequently, the oil is not discharged from the second bleeding passage so that there is no possibility of excessive decrease of the oil in the crank chamber.

Here, the first bleeding passage and the second bleeding passage each may independently include an orifice having a passage area reduced.

With such a configuration, the orifices are individually formed in the first bleeding passage configured to release the refrigerant gas in the crank chamber to the suction chamber and the second bleeding passage configured to release the working fluid containing the misted oil in the crank chamber to the suction chamber, so that a preferable orifice area can be set for each of the orifices, thereby making it possible to stabilize release of the refrigerant gas and discharge of superfluous oil.

The shaft may include: an axial hole of a limited length that is opened to the space defined by the insertion end portion of the shaft in the central hole and that extends along an axis from an insertion end of the shaft; and a crank-chamber-side hole extending from the axial hole in a radial direction and opened to the crank chamber.

In such a configuration, because communication from the crank chamber to the central hole space is achieved via the crank-chamber-side hole connected to the axial hole of the shaft, the working fluid that flows into the central hole space can be further decreased in oil concentration owing to the centrifugal separation effect by rotation of the shaft.

Alternatively, the shaft may include: an axial hole of a limited length that is opened to the space defined by the insertion end portion of the shaft in the central hole and that extends along an axis from an insertion end of the shaft; and a shaft-seal-chamber-side hole extending from the axial hole in a radial direction and opened to a shaft seal chamber that contains a seal member configured to seal a gap between the shaft and the front housing and that communicates with the crank chamber.

In such a configuration, because communication from the crank chamber to the central hole space is achieved via the shaft-seal-chamber-side hole connected to the axial hole of the shaft, the working fluid discharged from the crank chamber to the suction chamber can be made to flow via the shaft seal chamber, thereby effectively refrigerating and lubricating the shaft seal.

Further, the shaft may include: an axial hole of a limited length that is opened to the space defined by the insertion end portion of the shaft in the central hole and that extends along an axis from an insertion end of the shaft; a crank-chamber-side hole extending from the axial hole in a radial direction and opened to the crank chamber; and a shaft-seal-chamber-side hole extending from the axial hole in the radial direction and opened to a shaft seal chamber that contains a seal member configured to seal a gap between the shaft and the front housing and that communicates with the crank chamber.

In such a configuration, both of the above-described effects (the working fluid that flows into the central hole space can be decreased in oil concentration, and refrigeration and lubrication of the shaft seal can be performed) become possible.

An opening of the intake passage on the crank chamber side may be located in an end surface of the cylinder block on the crank chamber side and on a radially inner side of a portion of the cylinder block where a distance between adjacent cylinder bores is shortest. An opening of the second bleeding passage on the crank chamber side may be located in the end surface of the cylinder block that is opposed to the swash plate and in a region on a radially outer side of an imaginary circle that connects a portion where a distance between each of the cylinder bores and the central hole is shortest and on a radially inner side of the portion where the distance between the adjacent cylinder bores is shortest.

Here, the end surface on the crank chamber side in which the intake passage is opened includes, for example, the end surface of the cylinder block in which the cylinder bores are formed (the end surface opposed to the swash plate), and a bottom surface of a recess in which the central hole is opened in the case that the cylinder block includes the recess where the central hole is opened on the crank chamber side.

In such a configuration, the oil-mixed working fluid that returns from the discharge chamber to the crank chamber via the intake passage is jetted out from an outlet of the intake passage to the swash plate so as to lubricate sliding surfaces of the swash plate. The oil in the working fluid that has lubricated the swash plate is about to move radially outward due to a centrifugal effect of the working fluid that rotates along with rotation of the swash plate. However, unless the oil passes between the pistons inserted in the plural cylinder bores, the oil cannot move radially outward. Therefore, the misted oil in the working fluid inevitably passes in front of the second bleeding passage, so that the misted oil when passing in front can be drawn by suction into the second bleeding passage and discharged to the suction chamber effectively.

It is noted that the opening of the second bleeding passage on the crank chamber side may be located at a phase 180 degrees or more separate from the opening of the intake passage on the crank chamber side in a rotation direction of the swash plate.

In such a configuration, a position of the opening of the second bleeding passage is 180 degrees or more separate from a position of the opening of the intake passage in the rotation direction, so that there is no possibility that the oil in the working fluid that has returned from the intake passage to the crank chamber is drawn by suction out of the second bleeding passage prior to lubricating the swash plate.

Moreover, the opening of the second bleeding passage on the crank chamber side may be located below the first bleeding passage in the direction of gravity. The oil in the crank chamber is blown by rotation of the swash plate and misted. Then, under an influence of gravity, an oil density in the vicinity of a lower portion of the crank chamber is increased. Therefore, the opening of the second bleeding passage on the crank chamber side is located below the first bleeding passage in the direction of gravity, so that the misted oil in the crank chamber can be effectively discharged.

Figure 1:
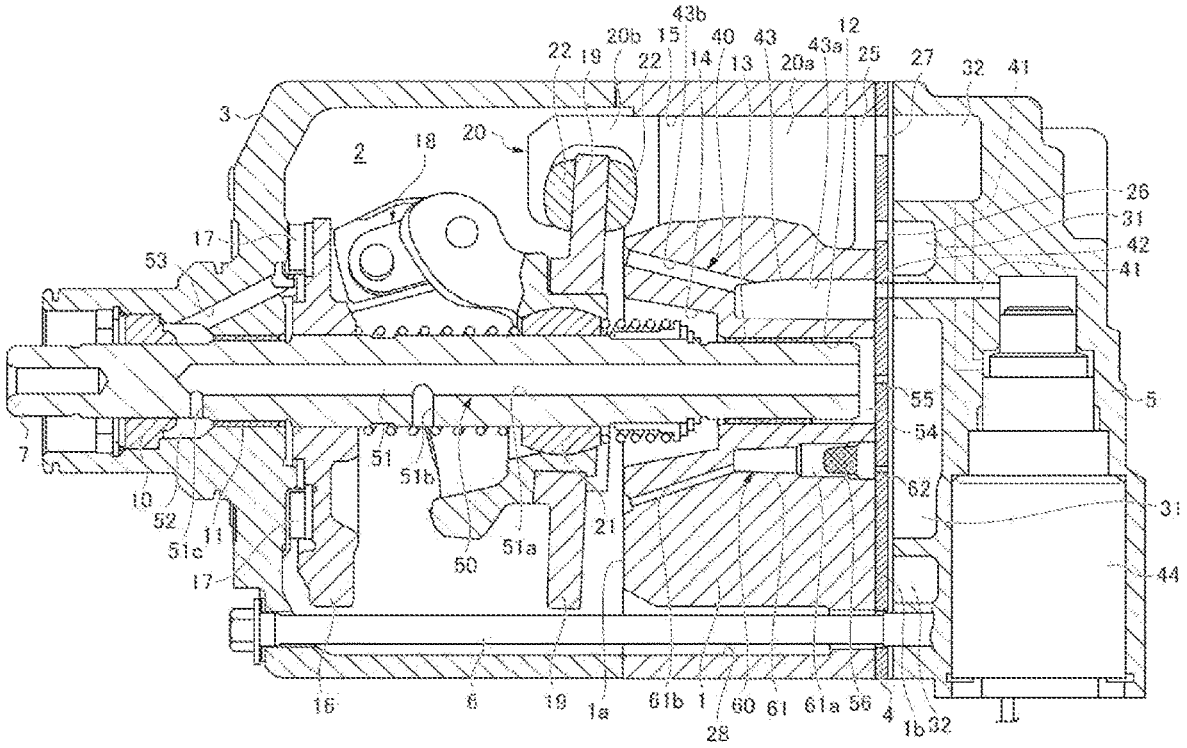
FIG. 1 is a cross-sectional view illustrating a first configuration example of a compressor according to the invention.
Figure 2A:
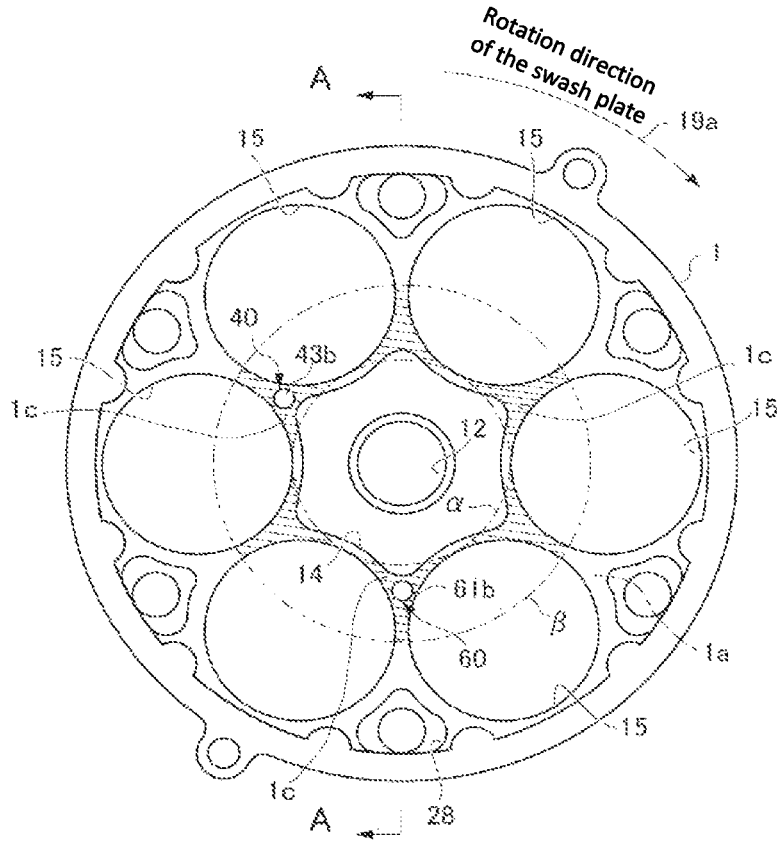
Figure 2B:
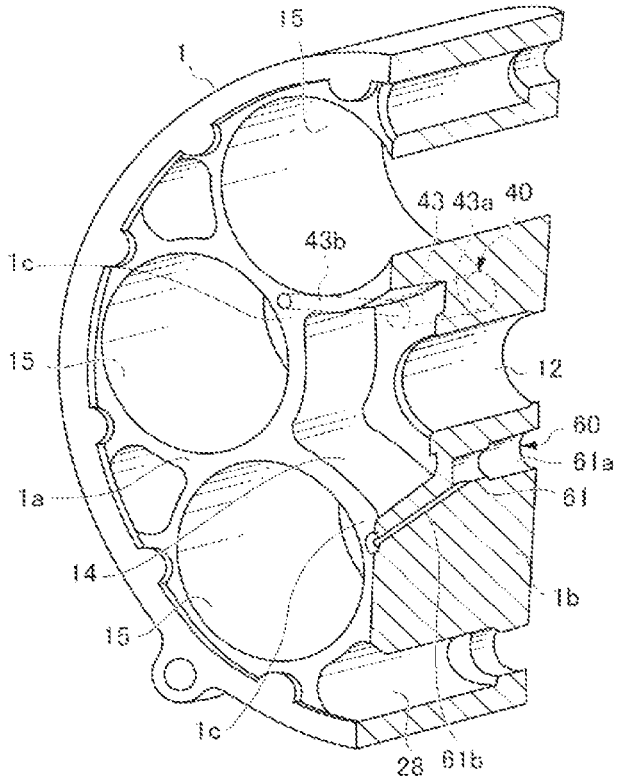

(a) of FIG. 2 is a view illustrating an end surface of a cylinder block used in the compressor of FIG. 1, which is opposed to a swash plate and faces a crank chamber (an end surface defining the crank chamber). (b) of FIG. 2 is a perspective view of the cylinder block cut away to reveal a second bleeding passage.

Figure 3A:
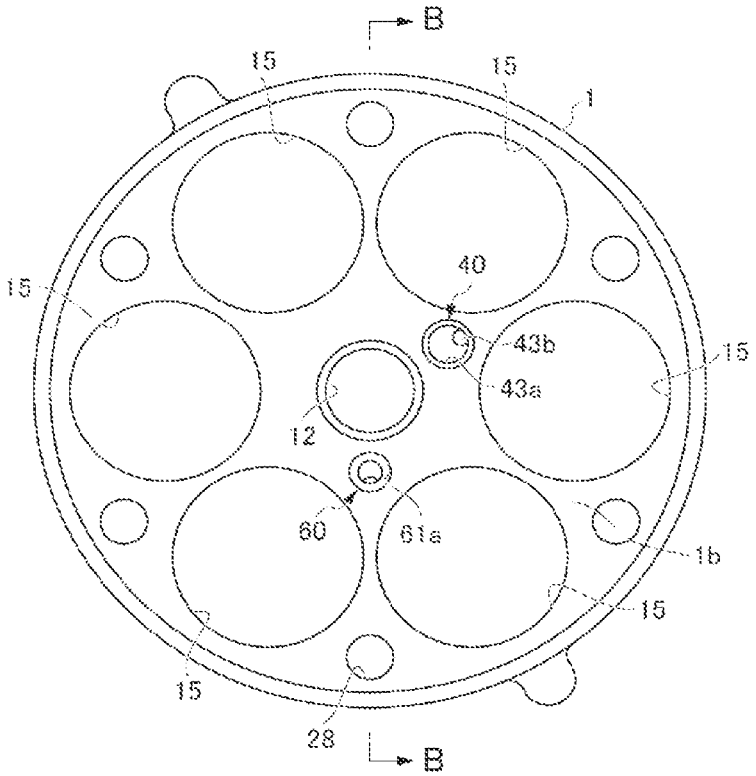
Figure 3B:
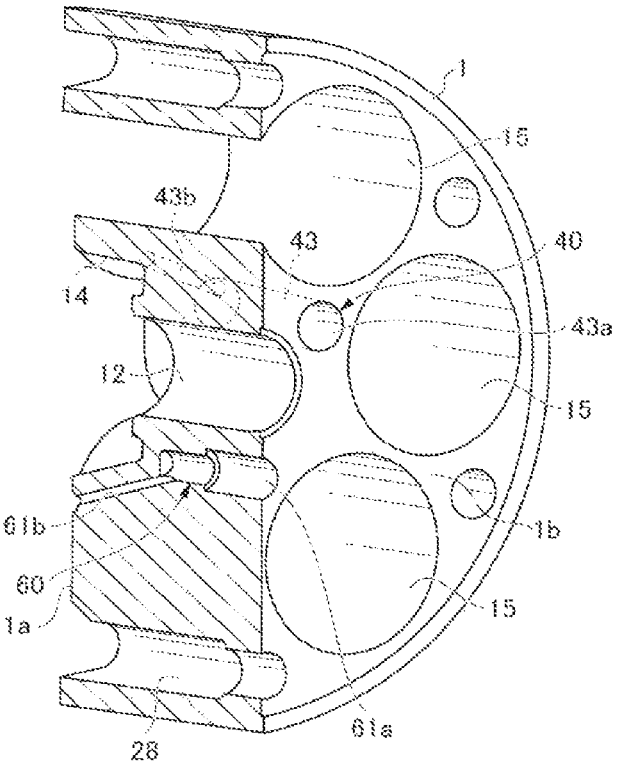

(a) of FIG. 3 is a view illustrating an end surface of a cylinder block used in the compressor of FIG. 1 on a valve plate side. (b) of FIG. 3 is a perspective view of the cylinder block cut away to reveal the second bleeding passage.

Figure 4:
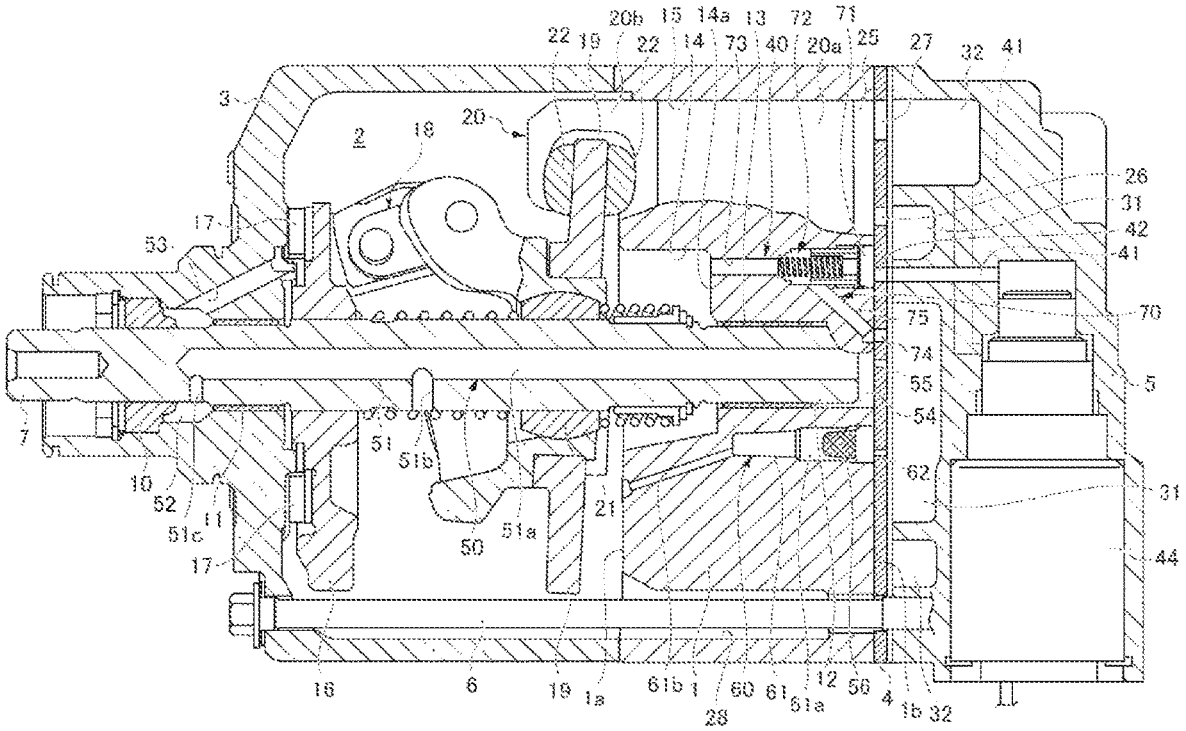

FIG. 4 is a cross-sectional view illustrating a second configuration example of the compressor according to the invention.

Figure 5A:
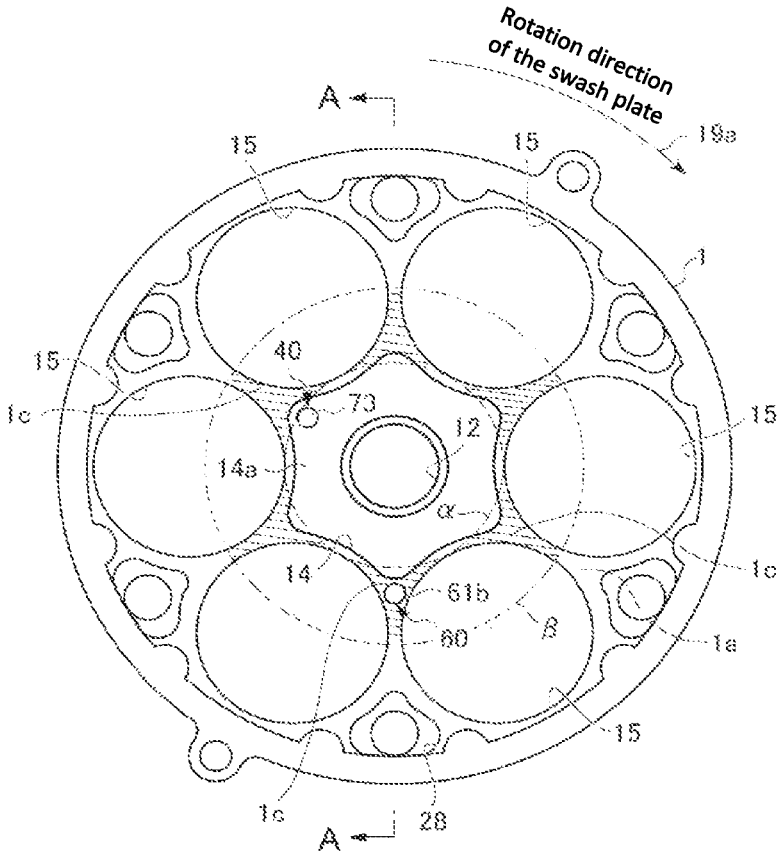
Figure 5B:
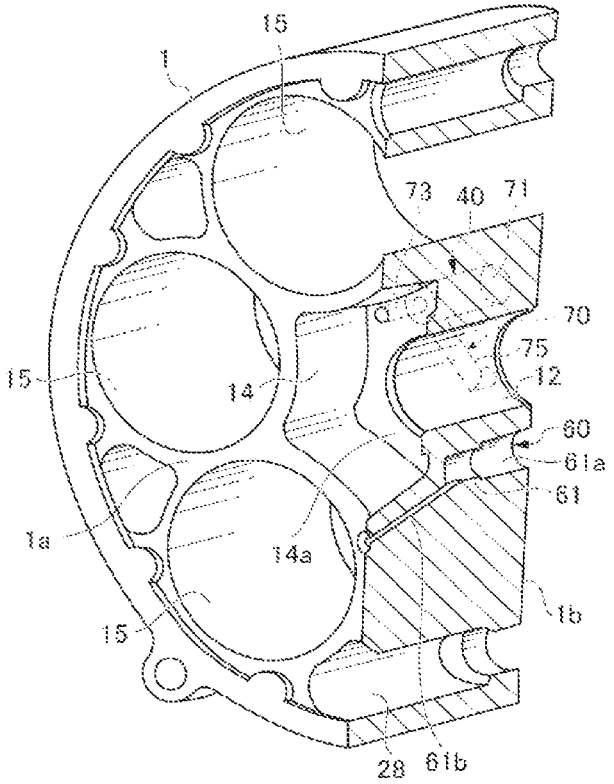

(a) of FIG. 5 is a view illustrating the end surface of the cylinder block used in the compressor of FIG. 3, which is opposed to the swash plate and faces the crank chamber (an end surface defining the crank chamber). (b) of FIG. 5 is a perspective view of the cylinder block cut away to reveal the second bleeding passage.

Figure 6A:
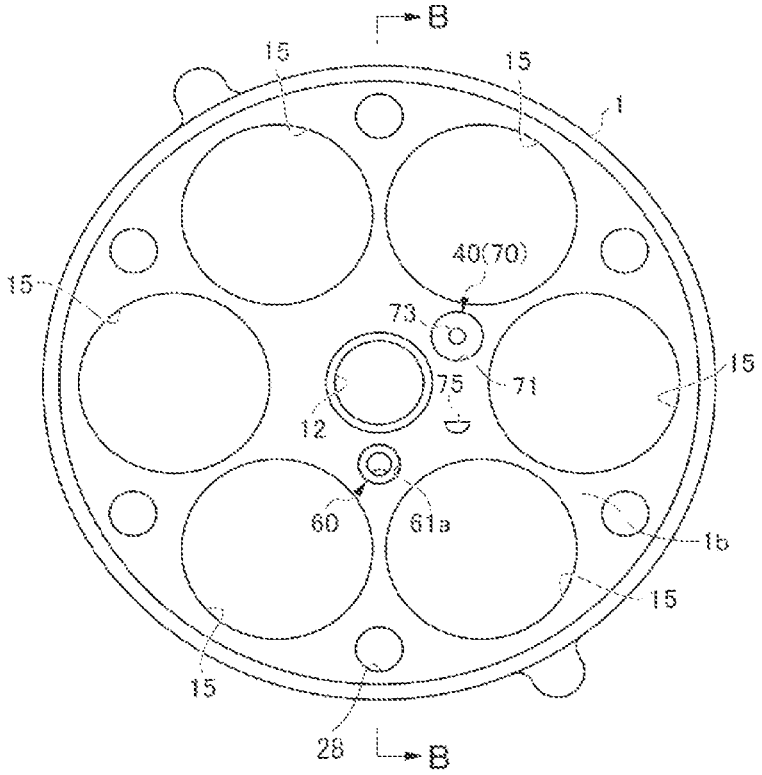
Figure 6B:
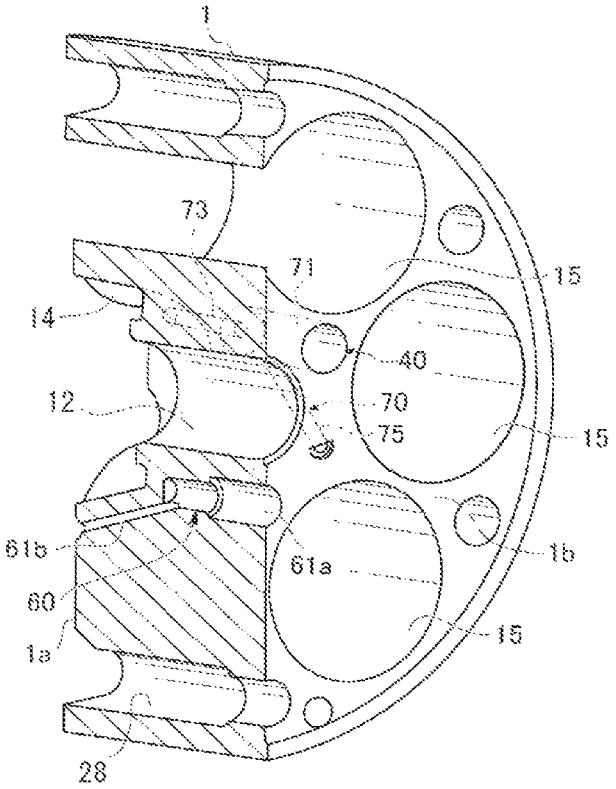

(a) of FIG. 6 is a view illustrating the end surface of the cylinder block used in the compressor of FIG. 3 on the valve plate side. (b) of FIG. 6 is a perspective view of the cylinder block cut away to reveal the second bleeding passage.

DESCRIPTION OF EMBODIMENTS

Hereinafter, embodiments of this invention will be described with reference to the attached drawings.

In FIG. 1, a variable-displacement swash plate type compressor includes: a cylinder block 1; a front housing 3 attached over a front side of the cylinder block 1 and defining a crank chamber 2 between the front housing 3 and the cylinder block 1; and a rear housing 5 attached to a rear side of the cylinder block 1 via a valve plate 4. The front housing 3, the cylinder block 1, the valve plate 4, and the rear housing 5 are fastened in an axial direction by a fastening bolt 6.

A shaft 7 having a front end protruded from the front housing 3 is held in the crank chamber 2 defined by the front housing 3 and the cylinder block 1. A drive pulley, not illustrated, is disposed at a portion of the shaft 7 that is protruded from the front housing 3 so as to transmit a torque applied to the drive pulley to the shaft 7 via engagement of a clutch plate.

This front end side of the shaft 7 is hermetically sealed in the front housing 3 via a seal member 10 interposed between the shaft 7 and the front housing 3, and supported in a rotatable manner by a radial bearing 11. Also, a rear end side of the shaft 7 is supported in a rotatable manner by a radial bearing 13 held in a central hole 12 formed substantially in the center of the cylinder block 1. Here, the radial bearings 11 and 13 may be rolling bearings or plain bearings.

As illustrated in FIG. 2 and FIG. 3 as well, the cylinder block 1 is provided with a recess 14 in which the central hole 12 containing the radial bearing 13 is opened and that is opened to the crank chamber 2. Moreover, plural cylinder bores 15 are disposed at regular intervals on a circumference about the central hole 12 as the center. Each of the cylinder bores 15 is formed through the cylinder block 1 in the axial direction, and a piston 20 is inserted in each of the cylinder bores 15 in a reciprocative, slidable manner.

A thrust flange 16 configured to rotate integrally with the shaft 7 is secured to the shaft 7 in the crank chamber 2. The thrust flange 16 is supported via a thrust bearing 17 in a rotatable manner by an inner wall surface of the front housing 3 that is formed substantially perpendicular to the shaft 7. A swash plate 19 is then coupled to this thrust flange 16 via a link member 18.

The swash plate 19 is held in a tiltable manner via a hinge ball 21 disposed on the shaft 7, and rotates integrally in synchronism with rotation of the thrust flange 16.

To constitute the piston 20, a head portion 20*a* inserted in each of the cylinder bores 15 and an engagement portion 20*b* protruded to the crank chamber 2 are bonded in the axial direction. The engagement portion 20*b* is engaged with a peripheral edge portion of the swash plate 19 via a pair of shoes 22.

Therefore, when the shaft 7 rotates, the swash plate 19 accordingly rotates in such a manner that this rotary motion of the swash plate 19 is converted into reciprocating linear motion of the piston 20 via the shoes 22 so as to vary a volume of a compression chamber 25 defined between the piston 20 and the valve plate 4 in the cylinder bore 15.

A suction chamber 31 and a discharge chamber 32 formed outside the suction chamber 31 are formed in the rear housing 5. A suction hole 26 configured to allow the suction chamber 31 and the compression chamber 25 to communicate with each other via a suction valve (not illustrated), and a discharge hole 27 configured to allow the discharge chamber 32 and the compression chamber 25 to communicate with each other via a discharge valve (not illustrated) are formed in the valve plate 4.

In this configuration example, passages 41, 42, and 43 formed in the rear housing 5, the valve plate 4, and the cylinder block 1 form an intake passage 40 configured to allow the discharge chamber 32 and the crank chamber 2 to communicate with each other. In the rear housing 5, a pressure control valve 44 is also disposed in an intermediate portion of the intake passage 40 (passage 41). A valve mechanism (not illustrated) is disposed inside this pressure control valve 44. An opening degree of this valve mechanism is adjusted to regulate a flowrate of refrigerant that flows from the discharge chamber 32 into the crank chamber 2 via the intake passage 40 so as to control a pressure in the crank chamber 2.

As illustrated in FIG. 2 and FIG. 3 as well, the passage 43 is configured with an intake passage axial hole 43*a* formed substantially in parallel to the central hole 12 from an end surface 1*b* of the cylinder block 1 on a valve plate side, and an intake passage oblique hole 43*b* bored toward a rear side from an end surface 1*a* of the cylinder block 1 on a crank chamber side and passing between adjacent cylinder bores 15 so as to be connected to the intake passage axial hole 43*a*.

An opening of this intake passage 40 (intake passage oblique hole 43*b*) on the crank chamber side is formed in the end surface 1*a* of the cylinder block 1 on the crank chamber side. In this example, the opening is in the end surface 1*a* of the cylinder block 1 that is opposed to the swash plate 19, that is, a portion of the end surface in which the cylinder bores 15 and the recess 14 are formed and that is opposed to a slightly inner side of a portion of the sliding swash plate 19 that is in sliding contact with the shoes 22. Thus, the intake passage 40 supplies oil mixed in the refrigerant fed from the discharge chamber 32 via the pressure control valve 44, to a sliding contact surface of the swash plate 19 with the shoes 22. In particular, the intake passage 40 in this example is opened at the portion on a radially inner side of a narrowest portion between the adjacent cylinder bores 15 (the portion where a distance between the adjacent cylinder bores is shortest) and on a radially outer side of the recess 14 where the central hole 12 is opened (see (a) of FIG. 2).

Incidentally, a fluid discharge passage 51, described below, is disposed in the shaft 7. The fluid discharge passage 51 is configured with: an axial hole 51*a* of a limited length formed on an axis of the shaft 7 from the rear end halfway toward the front end; a crank-chamber-side hole 51*b* that communicates with the axial hole 51*a*, extends in the radial direction, and is opened to the crank chamber 2; and a shaft-seal-chamber-side hole 51*c* that communicates with the axial hole 51*a*, extends in the radial direction, and is opened to a shaft seal chamber 52 containing the seal member Here, the shaft seal chamber 52 communicates with the crank chamber 2 via a communication hole 53 bored through the front housing 3 and above the shaft seal chamber 52. The oil trickling down along an inner wall surface of the front housing 3 is partly guided to the shaft seal chamber 52 via the communication hole 53.

Moreover, a space defined by an insertion end portion of the shaft 7 in the central hole 12, that is, a space between the rear end of the shaft 7 and the valve plate 4 (hereinafter referred to as central hole space 54), communicates with the suction chamber 31 via an orifice hole 55 formed in the valve plate 4.

Therefore, in this configuration example in which the above-described fluid discharge passage 51 is formed in the shaft 7, this fluid discharge passage 51, the central hole space 54, and the orifice hole 55 form a first bleeding passage 50 configured to allow the crank chamber 2 and the suction chamber 31 to constantly communicate with each other.

The crank-chamber-side hole 51*b* of this first bleeding passage 50 (fluid discharge passage 51) functions to separate the oil from working fluid that flows in via the crank-chamber-side hole 51*b* by centrifugal force generated by rotation of the shaft 7, and mainly functions to cause the working fluid with a low oil content to flow in. The shaft-seal-chamber-side hole 51*c* also functions to take in by suction and discharge the oil excessively accumulated in the shaft seal chamber 52.

It is noted that in the above-described configuration as well, the working fluid that has flowed via the fluid discharge passage 51 flows in from the crank chamber 2 to the central hole space 54, and that the working fluid that has flowed from the recess 14 via a gap between the central hole 12 containing the radial bearing 13 and the shaft 7 is also allowed to flow in.

Therefore, even in the compressor in which the fluid discharge passage 51 is not formed in the shaft 7, the recess 14, the gap between the central hole 12 and the shaft 7, the central hole space 54, and the orifice hole 55 form the first bleeding passage 50 configured to allow the crank chamber 2 and the suction chamber 31 to constantly communicate with each other.

Furthermore, in this compressor, other than the first bleeding passage 50, a second bleeding passage 60 configured to allow the crank chamber 2 and the suction chamber 31 to constantly communicate with each other is formed. This second bleeding passage 60 is configured with a passage 61 formed in the cylinder block 1, and an orifice hole 62 communicating with this passage 61 and formed in the valve plate 4.

The passage 61 is configured with: a second bleeding passage axial hole 61*a* that is formed substantially in parallel to the central hole 12 from the end surface 1*b* of the cylinder block 1 on the valve plate 4 side and in which a filter 56 is detachably inserted; and a second bleeding passage oblique hole 61*b* bored toward the rear side from the end surface 1*a* of the cylinder block 1 on the crank chamber 2 side while passing between adjacent cylinder bores and communicating with the second bleeding passage axial hole 61*a*.

A portion of the second bleeding passage 60 that communicates with the crank chamber 2 (the portion where the passage 61 formed in the cylinder block 1 communicates with the crank chamber 2, that is, an opening on the crank chamber side) is formed in the end surface 1*a* of the cylinder block 1 that faces the crank chamber 2 and is opposed to the swash plate 19. That is, the portion of the second bleeding passage 60 that communicates with the crank chamber 2 is located on a radially inner side of a position where a bolt hole 28 in which the bolt 6 configured to fasten the housings is inserted is opened. Particularly in this example, the portion of the second bleeding passage 60 that communicates with the crank chamber 2 is located in a triangular region 1*c* (a hatched portion in (a) of FIG. 2) on a radially outer side of an imaginary circle a that connects a portion where a distance between each of the cylinder bores 15 and the central hole 12 is shortest, or on a radially outer side of the recess 14 where the central hole 12 is opened in this example, and on a radially inner side of an imaginary circle p that connects a narrowest portion between the adjacent cylinder bores (a portion where a distance between the bores is shortest).

It is noted that the intake passage oblique hole 43*b* has a smaller diameter than the intake passage axial hole 43*a*, and that the second bleeding passage oblique hole 61*b* has a smaller diameter than the second bleeding passage axial hole 61*a* so that even when manufacturing errors cause shape differences, passage constituents of the holes may be coupled to each other.

The portion where the above-described intake passage 40 is opened to the crank chamber 2 and the portion where the second bleeding passage 60 is opened to the crank chamber 2 have such a positional relationship that the opening of the second bleeding passage 60 on the crank chamber side is at a phase 180 degrees or more separate from the opening of the intake passage 40 on the crank chamber side in a rotation direction 19*a* of the swash plate 19 (at a phase approximately 240 degrees separate in the example illustrated in FIG. 2).

Moreover, in a state in which the compressor is installed while maintaining such a phase relationship, the opening of the second bleeding passage 60 on the crank chamber side is below the first bleeding passage 50 in the direction of gravity.

In the above-described configuration, when the shaft 7 is rotated by a torque applied to the drive pulley, the swash plate 19 is rotated, and this rotary motion of the swash plate 19 is converted into reciprocating linear motion of the pistons 20 via the shoes 22, thereby starting the pistons 20 to reciprocate in the cylinder bores 15. This reciprocating motion of the pistons 20 varies a volume of the compression chambers 25 formed between the pistons 20 and the valve plate 4 in the cylinder bores 15, and processes of suction, compression, and discharge of the working fluid are performed. That is, at the suction process, the pistons are displaced to increase the volume of the compression chambers 25 so as to take in the working fluid by suction from the suction chamber 31 into the compression chambers via the suction holes 26 opened/closed by the suction valves. At the compression process, the pistons 20 are displaced to decrease the volume of the compression chambers so as to discharge the compressed working fluid from the compression chambers 25 into the discharge chamber 32 via the discharge holes 27 opened/closed by the discharge valves.

A discharge amount from the compressor is determined by a stroke of the pistons 20. This stroke is determined by a difference pressure between a pressure exerted onto the front surfaces of the pistons 20, that is, a pressure in the compression chambers 25, and a pressure exerted onto the rear surfaces of the pistons 20, that is, a pressure in the crank chamber 2. Specifically, as the pressure in the crank chamber 2 is increased, the difference pressure between the compression chambers 25 and the crank chamber 2 is decreased to reduce an inclination angle (a swinging angle) of the swash plate 19, and consequently, the stroke of the pistons 20 is decreased to reduce the discharge displacement. Conversely, as the pressure in the crank chamber 2 is decreased, the difference pressure between the compression chambers 25 and the crank chamber 2 is increased to increase the inclination angle (swinging angle) of the swash plate 19, and consequently, the stroke of the pistons 20 is increased to increase the discharge displacement.

At the time of high rotation such as the time of acceleration, in order to reduce a motive power load of the compressor, an amount of refrigerant gas supplied from the discharge chamber 32 to the crank chamber 2 via the intake passage 40 is increased by the pressure control valve 44 so as to increase a crank chamber pressure.

Therefore, the swinging angle of the swash plate 19 is decreased (the piston stroke is decreased), thereby reducing the discharge amount. In such a case, because rotation of the shaft 7 is rapid, an oil separation function by the fluid discharge passage 51 is enhanced to make the oil more likely to accumulate in the crank chamber 2.

At this time, the oil in the crank chamber 2 is stirred by the swash plate 19 swinging and rotating, and is mixed with the refrigerant within the crank chamber and misted. This misted working fluid in which the oil and the refrigerant are mixed is rotated in the crank chamber by rotation of the swash plate 19. Consequently, due to a centrifugal separation effect, the working fluid in a region on a radially outer side of the crank chamber has a high concentration of the oil component whereas the working fluid in a region on a radially inner side of the crank chamber has a low concentration of the oil component.

Because the first bleeding passage 50 communicates with the crank chamber 2 via the central hole space 54 of the central hole 12 in the cylinder block 1, the working fluid having a low oil concentration (that is, the refrigerant gas) in the crank chamber can be stably discharged. Moreover, the working fluid that flows into the central hole space 54 can be further decreased in oil concentration by the centrifugal separation effect when introduced from the crank-chamber-side hole 51*b*.

With this configuration, the oil is more likely to accumulate in the crank chamber. However, because the second bleeding passage 60 is opened in the end surface (the end surface of the cylinder block 1 at the location on a radially inner side of the position where the bolt hole 28 is opened) 1*a* of the cylinder block 1 that faces the crank chamber 2 and is opposed to the swash plate 19, the working fluid having a relatively high concentration of the oil component can be discharged by the pressure difference between the crank chamber 2 and the suction chamber 31. Thus, the misted oil generated by stirring with the swash plate 19 can be discharged to hinder accumulation of excessive oil in the crank chamber 2 so as to prevent the oil temperature from being increased by oil stirring.

Meanwhile, the oil on a radially outer side that flows into the bolt hole 28 (oil on a radially outer side of a locus of rotation of the swash plate 19) is hardly stirred by the swash plate 19 but stagnates without being misted and is not discharged from the second bleeding passage 60 in consequence. For this reason, regardless of an operation condition, the inconvenience that the oil in the crank chamber is excessively reduced is eliminated.

In the end surface of the cylinder block 1 on the crank chamber side, the opening of the intake passage 40 on the crank chamber side is located on a radially inner side of the portion of the cylinder block 1 where the distance between the adjacent cylinder bores of the cylinder block 1 is shortest. The opening of the second bleeding passage 60 on the crank chamber side is located in the above-described triangular region 1*c* of the end surface of the cylinder block 1 that is opposed to the swash plate 19. Therefore, the oil-mixed working fluid is jetted out of the intake passage 40 to the swash plate 19 so as to lubricate sliding surfaces of the swash plate 19. This working fluid that has lubricated the swash plate 19 rotates along with rotation of the swash plate 19. Due to a centrifugal action, the oil in the working fluid, which is about to move radially outward, cannot move radially outward unless the oil passes between the pistons 20 inserted in the cylinder bores 15. Therefore, the oil in the working fluid collides with the adjacent pistons, for example, and rotation of the oil is slowed down. Meanwhile, the oil runs down the triangular regions 1*c* of the cylinder block 1 and moves between the adjacent pistons 20. Thus, the oil in the working fluid is made more likely to pass in front of the second bleeding passage 60. Particularly in this example, because the opening of the second bleeding passage on the crank chamber side is below the first bleeding passage in the direction of gravity, the oil in the working fluid that has been blown radially outward by rotation of the swash plate 19 is made even more likely to pass in front of the second bleeding passage 60 owing to an action of gravity combined. The oil in the working fluid when passing in front of the second bleeding passage 60 is drawn by suction into the second bleeding passage 60 and discharged to the suction chamber 31. That is, the working fluid containing the oil that has been provided for lubricating the swash plate 19 is mainly discharged from the second bleeding passage.

Furthermore, in the above example, the opening of the second bleeding passage 60 on the crank chamber side is located at a phase 180 degrees or more separate from the opening of the intake passage 40 on the crank chamber side in the rotation direction 19*a* of the swash plate 19. Therefore, there is no possibility that the oil in the working fluid that has returned from the intake passage 40 to the crank chamber 2 is drawn by suction out of the second bleeding passage prior to lubricating the swash plate 19, and there is no possibility of degrading lubrication of the swash plate 19.

In this manner, with this configuration, the intake passage 40 is opened while opposed to the swash plate 19, so that sufficient lubrication of the swash plate 19 can be secured. Moreover, the misted oil after provided for lubricating the swash plate 19 can be discharged from the second bleeding passage 60 so as to prevent excessive oil from accumulating in the crank chamber 2. Furthermore, the oil that is not misted by stirring with the swash plate 19 is stagnated within the crank chamber so as not to be discharged from the second bleeding passage 60. The above configuration makes it possible to avoid the inconvenience that the oil in the crank chamber may be exhausted dependent upon an operation condition, and makes it possible to constantly maintain an appropriate amount of the oil in the crank chamber.

Furthermore, in the above configuration, the orifice hole 55 of the first bleeding passage 50 and the orifice hole 62 of the second bleeding passage 60 are provided separately. Therefore, adjusting sizes of the orifice holes 55 and 62 makes it possible to independently regulate an amount of bleeding gas guided to the suction chamber 31 via the fluid discharge passage 51 (first bleeding passage 50) and an amount of the oil guided to the suction chamber 31 via the second bleeding passage 60. Thus, with this compressor, the amount of bleeding gas and the discharge amount of the oil can be individually regulated to obtain a desired property.

Incidentally, in the above example, the intake passage 40 is opened in the end surface 1*a* of the cylinder block 1 that is opposed to the swash plate 19 and in which the cylinder bores 15 are formed. However, as long as high-pressure gas of the discharge chamber 32 can be introduced into the crank chamber 2, the intake passage 40 may not be opened in the end surface 1*a* opposed to the swash plate 19 but opened in another end surface on a radially inner side of the portion of the cylinder block 1 where the distance between the adjacent cylinder bores is shortest.

Such an example is illustrated in FIG. 4. In this example, the opening of the intake passage 40 to the crank chamber 2 side is opened in a bottom surface 14*a* of the recess 14 where the central hole 12 is opened.

Moreover, in this example, a valve containing space 71 is disposed in a portion of the intake passage 40 at a downstream side of the pressure control valve 44, and a bleeding control valve 72 is held slidably in this valve containing space 71. The valve containing space 71 extends substantially in parallel to the shaft 7 from the end surface 1*b* of the cylinder block 1 that is opposed to the valve plate 4. An upstream end (an open end opposed to the valve plate 4) of this valve containing space 71 communicates with the through hole 42 formed in the valve plate 4 that constitutes a part of the intake passage 40. A downstream end portion of the valve containing space 71 is connected to a passage 73 communicating with the crank chamber 2. Moreover, a branch passage 75 is connected to the vicinity of a downstream end of the valve containing space 71. The branch passage 75 is formed in the cylinder block 1 and connected to a communication hole 74 formed in the valve plate 4 so as to communicate with the suction chamber 31 via this communication hole 74. This branch passage 75, and the communication hole 74 formed in the valve plate 4 form a third bleeding passage 70 that branches from a downstream side of the pressure control valve 44 of the intake passage 40, that communicates with the suction chamber 31, and that is opened/closed by the bleeding control valve 72.

An opening degree of this bleeding control valve 72 that allows the crank chamber 2 and the branch passage 75 to communicate with each other via a portion of the intake passage 40 that is at a downstream side of the bleeding control valve 72 varies in accordance with a difference between a pressure at a downstream side of the pressure control valve 44 in the intake passage and a pressure in the crank chamber 2. In the case that the pressure at the downstream side of the pressure control valve 44 in the intake passage 40 is lower than the pressure in the crank chamber 2, this compressor increases the opening degree of communication between the crank chamber 2 and the branch passage 75 so as to quickly release the pressure in the crank chamber 2 to the suction chamber 31. In the case that the pressure at the downstream side of the pressure control valve 44 is higher than the pressure in the crank chamber 2, this compressor decreases the opening degree of communication between the crank chamber 2 and the branch passage 75 so as to obtain the original function of the intake passage of causing the working fluid to flow from the upstream side to the downstream side of the intake passage 40 via the bleeding control valve 72 and introducing the working fluid to the crank chamber 2.

It is noted that a specific configuration, operation and functions of such a bleeding control valve 72 are substantially the same as disclosed in Japanese Patent Application No. 2018-13851 so that a description thereof will be omitted.

Because other components such as the first bleeding passage 50 and the second bleeding passage 60 are substantially the same as in the configuration example in FIG. 1, the same portions are denoted with identical symbols, and a description thereof will be omitted.

In such a configuration, because the intake passage 40 is opened in the bottom surface 14*a* of the recess 14 of the cylinder block 1 where the central hole 12 is opened, the oil supplied via the intake passage 40 becomes less likely to be directly blown onto outer-peripheral portions of the swash plate 19. However, because the second bleeding passage 60 is opened in the end surface 1*a* of the cylinder block 1 that faces the crank chamber 2 and is opposed to the swash plate 19 (opened on a radially inner side of the portion where the bolt hole 28 on a radially outer side of the locus of rotation of the swash plate 19 is opened), the oil remains in the crank chamber 2 to such a suitable extent that outer edge portions of the swash plate 19 are immersed, as described above. Consequently, along with the oil supplied from the intake passage 40, sufficient oil can be supplied to the swash plate 19, and lubrication of the swash plate 19 can be secured.

Moreover, in the compressor of this configuration, the third bleeding passage 70 opened/closed by the bleeding control valve 72 is provided other than the second bleeding passage 60, so that superfluous oil in the crank chamber can be discharged via the second bleeding passage 60, and that excessive discharge of the oil can be prevented. Furthermore, in the case that the pressure at the downstream side of the pressure control valve 44 in the intake passage 40 is lower than the pressure in the crank chamber 2, the bleeding control valve 72 can increase the opening degree of communication between the crank chamber 2 and the branch passage 75 so as to quickly release the pressure in the crank chamber 2 to the suction chamber 31. Therefore, at a start-up of the compressor, while an appropriate amount of the oil is maintained in the crank chamber, it is possible to shorten time in which the liquid refrigerant that has accumulated in the crank chamber is vaporized and discharged to the suction chamber 31, and it is possible to shorten time until discharge displacement control of the compressor can be performed.

REFERENCE SIGNS LIST

1: cylinder block
1*a*: end surface
2: crank chamber
3: front housing
4: valve plate
5: rear housing
7: shaft
12: central hole
15: cylinder bore
19: swash plate
20: piston
25: compression chamber
31: suction chamber
32: discharge chamber
40: intake passage
50: first bleeding passage
51: fluid discharge passage
51*a*: axial hole
51*b*: crank-chamber-side hole
51*c*: shaft-seal-chamber-side hole
52: shaft seal chamber
54: central hole space
55: orifice hole
60: second bleeding passage
62: orifice hole
70: third bleeding passage

The invention claimed is:

1. A variable-displacement swash plate type compressor comprising:

a cylinder block in which plural cylinder bores are formed;

a front housing assembled with a front side of the cylinder block and defining a crank chamber;

a rear housing that is attached to a rear side of the cylinder block and in which a suction chamber and a discharge chamber are formed;

a shaft supported in a rotatable manner by the front housing and a central hole formed in a center of the cylinder block;

a swash plate configured to rotate integrally with the shaft and attached at a variable inclination angle with respect to the shaft;

pistons that are disposed in the plural cylinder bores disposed around the central hole of the cylinder block and that are configured to reciprocate by rotation of the swash plate; an intake passage configured to allow the discharge chamber and the crank chamber to communicate with each other;

a pressure control valve disposed in the intake passage and configured to adjust an opening degree of the intake passage;

a first bleeding passage configured to allow the crank chamber and the suction chamber to constantly communicate with each other; and a second bleeding passage configured to allow the crank chamber and the suction chamber to constantly communicate with each other, wherein the first bleeding passage is configured to communicate with the crank chamber at least via a space defined by an insertion end portion of the shaft in the central hole, and wherein the second bleeding passage is opened in an end surface of the cylinder block at a position that is opposed to the swash plate with respect to an axial direction defined by the shaft, wherein the second bleeding passage comprises an axial end and an oblique end, where the axial end has a larger diameter than a diameter of the oblique end, positioned to couple together, wherein the oblique end is positioned towards the swash plate and the axial end is positioned away from the swash plate, and wherein the axial end comprises a filter.

2. The variable-displacement swash plate type compressor according to claim 1, wherein the first bleeding passage and the second bleeding passage each independently comprise an orifice having a passage area reduced.

3. The variable-displacement swash plate type compressor according to claim 1, wherein the shaft comprises:

an axial hole of a limited length that is opened to the space defined by the insertion end portion of the shaft in the central hole and that extends along an axis from the insertion end portion of the shaft, and a crank-chamber-side hole extending from the axial hole in a radial direction and opened to the crank chamber.

4. The variable-displacement swash plate type compressor according to claim 1, wherein the shaft comprises:

an axial hole of a limited length that is opened to the space defined by the insertion end portion of the shaft in the central hole and that extends along an axis from the insertion end portion of the shaft, and a shaft-seal-chamber-side hole extending from the axial hole in a radial direction and opened to a shaft seal chamber that contains a seal member configured to seal a gap between the shaft and the front housing and that communicates with the crank chamber.

5. The variable-displacement swash plate type compressor according to claim 1, wherein the shaft comprises:

an axial hole of a limited length that is opened to the space defined by the insertion end portion of the shaft in the central hole and that extends along an axis from the insertion end portion of the shaft, a crank-chamber-side hole extending from the axial hole in a radial direction and opened to the crank chamber, and a shaft-seal-chamber-side hole extending from the axial hole in the radial direction and opened to a shaft seal chamber that contains a seal member configured to seal a gap between the shaft and the front housing and that communicates with the crank chamber.

6. The variable-displacement swash plate type compressor according to claim 1, wherein an opening of the intake passage on the crank chamber side is located in an end surface of the cylinder block on the crank chamber side and on a radially inner side of a portion of the cylinder block where a distance between adjacent cylinder bores is shortest, and an opening of the second bleeding passage on the crank chamber side is located in the end surface of the cylinder block that is opposed to the swash plate and in a region on a radially outer side of an imaginary circle that connects a portion where a distance between each of the cylinder bores and the central hole is shortest and on a radially inner side of the portion where the distance between the adjacent cylinder bores is shortest.

7. The variable-displacement swash plate type compressor according to claim 6, wherein the opening of the second bleeding passage on the crank chamber side is located at a phase 180 degrees or more separate from the opening of the intake passage on the crank chamber side in a rotation direction of the swash plate.

8. The variable-displacement swash plate type compressor according to claim 1, wherein the opening of the second bleeding passage on the crank chamber side is located below the first bleeding passage in a direction of gravity.

* * * * *